US006710759B1

(12) United States Patent
Kondoh

(10) Patent No.: US 6,710,759 B1
(45) Date of Patent: Mar. 23, 2004

(54) FERROELECTRIC LIQUID CRYSTAL DEVICE AND DRIVING METHOD TO PREVENT THRESHOLD VOLTAGE CHANGE

(75) Inventor: Shinya Kondoh, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/582,027

(22) PCT Filed: Oct. 22, 1999

(86) PCT No.: PCT/JP99/05847

§ 371 (c)(1),
(2), (4) Date: Jun. 21, 2000

(87) PCT Pub. No.: WO00/23848

PCT Pub. Date: Apr. 27, 2000

(30) Foreign Application Priority Data

Oct. 22, 1998 (JP) ..... 10-300606

(51) Int. Cl.[7] ..... G09G 3/36
(52) U.S. Cl. ..... 345/92; 345/94; 349/100
(58) Field of Search ..... 345/87–97; 349/100, 349/172–174

(56) References Cited

U.S. PATENT DOCUMENTS 5,151,803 A * 9/1992 Wakita et al. ..... 345/97
6,369,789 B1 * 4/2002 Ulrich et al. ..... 345/97

FOREIGN PATENT DOCUMENTS

| | | |
|---|---|---|
| EP | 0 256 548 | 2/1988 |
| EP | 0 424 958 | 5/1991 |
| EP | 0 469 531 | 2/1992 |
| JP | 04-175724 | 6/1992 |
| JP | 05-002376 | 1/1993 |

* cited by examiner

*Primary Examiner*—Amr Awad
(74) *Attorney, Agent, or Firm*—Finnegan, Henderson, Farabow, Garrett & Dunner, L.L.P.

(57) ABSTRACT

A ferroelectric liquid crystal display element holds a ferroelectric liquid crystal between a pair of substrates. A driving scheme includes a reset period having a switching period and a non-switching period which precede application of a selection pulse. During the switching period, a voltage exceeding a threshold voltage required to switch the ferroelectric liquid crystal is applied irrespective of the display data to be written to a pixel, and during the non-switching period, an ion electric field in the ferroelectric liquid crystal is aligned in such a direction that cancels the direction of an electric field produced by spontaneous polarization of the liquid crystal molecules. A voltage not exceeding the threshold voltage of the ferroelectric liquid crystal, preferably a voltage of 0 V, that is, no voltage, is applied during the non-switching period.

12 Claims, 11 Drawing Sheets

PRIOR ART (a)

FERROELECTRIC LIQUID CRYSTAL DEVICE AND DRIVING METHOD TO PREVENT THRESHOLD VOLTAGE CHANGE

TECHNICAL FIELD

The present invention relates to a ferroelectric liquid crystal display device; more particularly, the invention relates to a liquid crystal display device wherein an image sticking phenomenon of a liquid crystal display screen is eliminated by preventing the threshold voltage of the liquid crystal from changing, and also relates to a method for driving the same.

BACKGROUND ART

In recent years, research and development has been carried out vigorously on liquid crystal display devices that utilize ferroelectric liquid crystals having properties, such as fast response speed and memory effect, that distinguish them from conventional liquid crystals. Liquid crystal display elements utilizing ferroelectric liquid crystals are finding widespread use in such applications as display apparatuses and liquid crystal shutters.

FIG. 1 is a diagram showing the arrangement of polarizers when the ferroelectric liquid crystal is used as a liquid crystal display element. A liquid crystal cell 2 is placed between the polarizers 1*a* and 1*b* arranged in a crossed nicols configuration in such a manner that the long axis direction of liquid crystal molecules when the molecules are in a first stable state or in a second stable state is substantially parallel to either the polarization axis, a, of the polarizer 1*a* or the polarization axis, b, of the polarizer 1*b*.

When voltage is applied across the thus arranged liquid crystal cell, its light transmittance varies with the applied voltage, describing a loop as plotted in the graph of FIG. 2.

The switching of the ferroelectric liquid crystal, that is, a transition from one stable state to the other stable state, occurs only when a voltage of such a value that the product of the width value and crest value of the applied voltage waveform is larger than the threshold value is applied to the ferroelectric liquid crystal molecules. As shown in FIG. 2, either the first stable state (non-transmission (black) display state) or the second stable state (transmission (white) display state) is selected depending on the polarity of the applied voltage.

Here, the voltage value at which the light transmittance begins to change when the applied voltage is increased is denoted by V1, and the voltage value at which the light transmittance reaches saturation is denoted by V2; on the other hand, when the applied voltage is decreased and a voltage of opposite polarity is applied, the voltage value at which the light transmittance begins to drop is denoted by V3, and the voltage value at and beyond which the light transmittance does not drop further is denoted by V4. AS shown in FIG. 2, the second stable state is selected when the value of the applied voltage is greater than the threshold value of the ferroelectric liquid crystal molecules. When a voltage of opposite polarity greater in magnitude than the threshold value of the ferroelectric liquid crystal molecules is applied, the first stable state is selected.

When the polarizers are arranged as shown in FIG. 1, a white display (transmission state) can be produced in the second stable state and a black display (non-transmission state) in the first stable state. The arrangement of the polarizers can be changed so that the black display (non-transmission state) is produced in the second stable state and the white display state (transmission state) in the first stable state. The description hereinafter given, however, assumes that the white display (transmission state) is produced in the second stable state and the black display (non-transmission state) in the first stable state.

As one method for driving a ferroelectric liquid crystal display device, a time division driving method has been known in the art. In the time division driving method, a plurality of scanning electrodes and signal electrodes are formed on the substrates, and the liquid crystal display device is driven by applying voltages to the respective electrodes. FIG. 3 shows a driving scheme used in the time division driving method for driving the ferroelectric liquid crystal. As shown in FIG. 3, writing to a pixel is done by applying a scanning voltage (a) to its associated scanning electrode and a signal voltage (b) to its associated signal electrode, thereby applying their combined voltage (c) to the pixel. In the figure, (d) shows the light transmittance of the liquid crystal display device. Usually, each selection period (Se) is preceded by a reset period (Rs). NSe denotes a non-selection period. In the case of FIG. 3, the pixel is forcibly reset to the black display state (the first stable state) in the reset period (Rs) irrespective of its display data.

As shown in the left-hand half of FIG. 3, when producing a black display, a voltage that, as the combined voltage (c), does not exceed the threshold value is applied during the selection period (Se), and the state achieved in the reset period (RS) is thus retained. On the other hand, as shown in the right-hand half of FIG. 3, when producing a white display, a voltage that, as the combined voltage (c), exceeds the threshold value for the second stable state, is applied during the selection period (Se).

In the conventional art, it is known to apply during the reset period, a voltage scheme consisting of a single-polarity pulse or a bipolar pulse or a succession of bipolar pulses.

Ferroelectric liquid crystals exhibit spontaneous polarization and hence have the memory effect by which the written display state is maintained. However, if this memory effect is too strong, a phenomenon known as an image sticking phenomenon, in which the previously written display state persists and interferes with the writing of a new display state, becomes evident.

To prevent such an image sticking phenomenon, it has traditionally been practiced to form an alignment film using a material that has the property of preventing ionic impurities from adhering in the vicinity of the alignment film. Furthermore, when not using the display for a long period of time, it has been practiced to put the entire display screen into a mixed state of microscopic white or black regions and hold it in this state, thereby canceling, in the liquid crystal display screen as a whole, the internal electric field produced by the spontaneous polarization within the cell.

It has generally been believed that such an image sticking phenomenon occurs after the screen has been held in the same display state for a long period of time. The inventor, however, has discovered that one of the causes of image sticking phenomenon is a change in the threshold voltage required to cause a transition from the first stable state to the second stable state, and that the image sticking phenomenon can occur in a short period of time. It has also been found that the reset period employed in the prior art is not sufficient to prevent the image sticking phenomenon.

In view of the above situation, it is an object of the present invention to resolve the problem of image sticking phenomenon by providing a driving method which prevents such a threshold voltage change occurring in a short period of time.

DISCLOSURE OF THE INVENTION

To achieve the above object, the ferroelectric liquid crystal display element of the present invention comprises a ferroelectric liquid crystal between a pair of substrates, and a drive waveform for driving the liquid crystal includes a reset period having a switching period and a non-switching period which precede a selection period wherein, during the switching period, a voltage exceeding a threshold voltage required to switch the ferroelectric liquid crystal is applied irrespective of the display data to be written to a pixel, and during the non-switching period, an ion electric field in the ferroelectric liquid crystal is aligned in such a direction that it cancels the direction of an electric field produced by spontaneous polarization of liquid crystal molecules.

For example, a voltage applied during the non-switching period does not exceed the threshold voltage of the ferroelectric liquid crystal. Preferably, a voltage of 0 V, that is, no voltage, is applied.

The voltage applied during the switching period is a set of bipolar pulses.

The length ΔT of the non-switching period is set so as to minimize the change in the threshold voltage.

The reset period is set with the same timing for all pixels.

Alternatively, the reset period is set each time display data is written to a pixel.

In that case, the length of the non-switching period is the same for all pixels.

At the end of a display operation of the ferroelectric liquid crystal display device, a switching pulse as applied during the reset period is applied to all the pixels to set them in the resulting state.

ADVANTAGEOUS EFFECT OF THE INVENTION

Using the ferroelectric liquid crystal display element of the invention or the driving method for the same, it becomes possible to suppress the change in the threshold voltage which occurs due to the display state of the liquid crystal panel. This serves to prevent the image sticking phenomenon caused by the change in the threshold voltage. This also serves to reduce the display flicker occurring during the non-selection period, allow a greater margin of driving with respect to temperature variations, and achieve a good display.

DETAILED DESCRIPTION OF THE INVENTION

Figure 4:
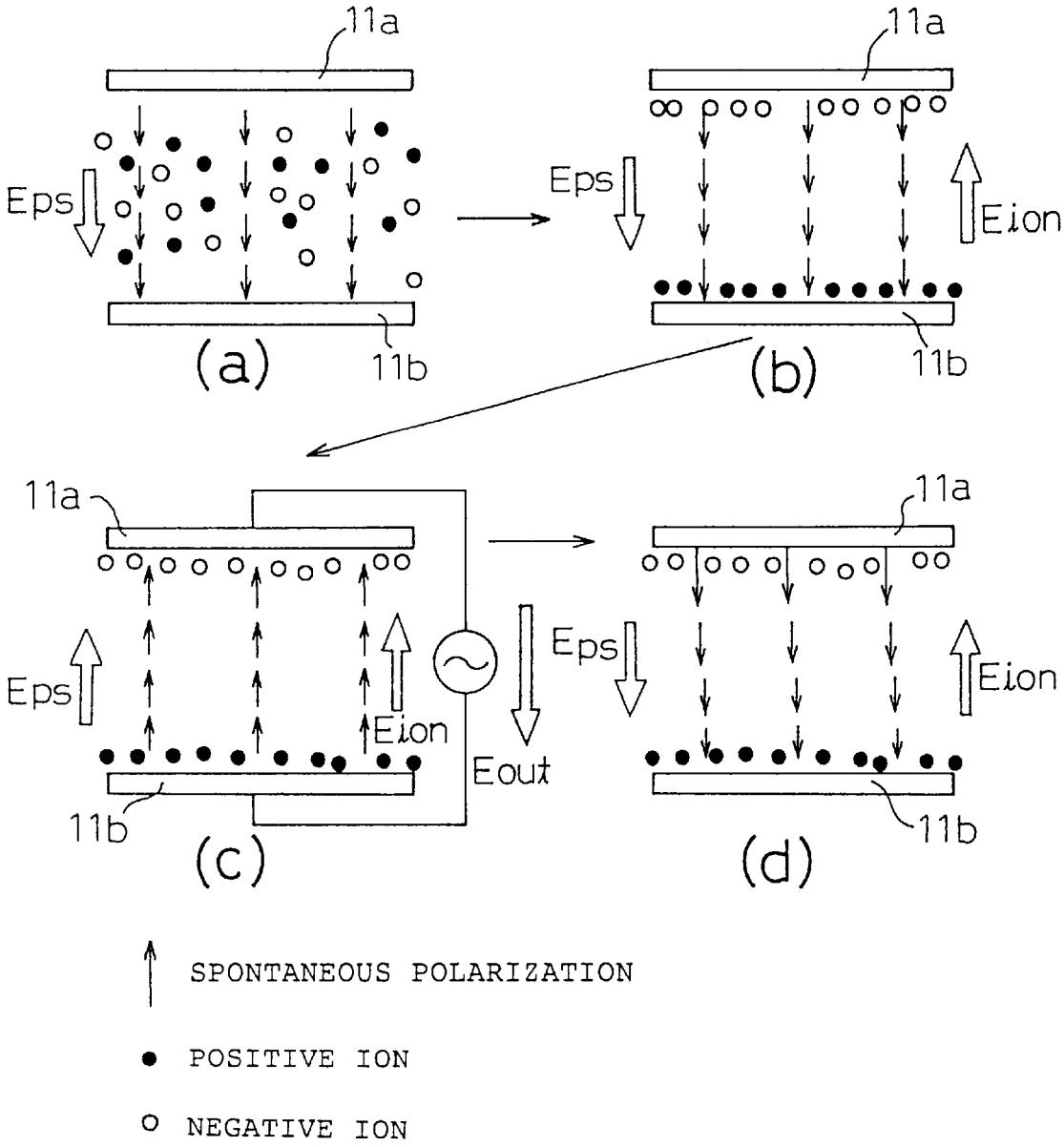
FIG. 4 is a diagram for explaining how an image sticking phenomenon occurs in the ferroelectric liquid crystal display element.

FIG. 4 is a diagram for explaining how image sticking phenomenon occurs in a ferroelectric liquid crystal. FIG. 4 shows a model illustrating the ion polarity and the direction of the spontaneous polarization that the liquid crystal molecules exhibit when the ferroelectric liquid crystal is sandwiched between a pair of glass substrates 11*a* and 11*b*.

Since ferroelectric liquid crystal molecules possess spontaneous polarization, ionic impurities remaining in the ferroelectric liquid crystal are attracted to the surfaces of the alignment films by the action of the internal electric field (EPs) produced within the cell by the spontaneous polarization, and an ion electric field (Eion) occurs in a direction that cancels the EPs. This phenomenon causes a change from the state of FIG. 4(*a*) to the state of FIG. 4(*b*). As shown in FIG. 4(*c*), when an external voltage (Eout) is applied, switching occurs in the liquid crystal molecules. When the external voltage is removed, the liquid crystal molecules should retain the orientation shown in FIG. 4(*c*). In reality, however, the orientation of the liquid crystal molecules is reversed by the action of the ion electric field (Eion), as shown in FIG. 4(*d*). This is believed to cause the image sticking phenomenon.

As earlier described, it has generally been believed that image sticking phenomenon occurs because the same display state has been maintained for a long period of time. The inventor, however, has discovered that the image sticking phenomenon can occur in a short period of time for the reason described above.

The image sticking phenomenon that occurs in a short period of time will be explained with reference to FIG. 5. The ferroelectric liquid crystal display device is driven using the conventional driving method illustrated, for example, in FIG. 3. The voltage value of the selection pulse applied during the selection period is increased starting from 0 V. When the applied voltage exceeds V1 shown in FIG. 2, the ferroelectric liquid crystal switches from the first stable state to the second stable state; as a result, the amount of light transmission changes and a white display is produced. This relationship between the amount of light transmission and the applied voltage is shown by a solid line (1) in FIG. 5. After that, when a bipolar pulse is applied to the same pixel in the reset period (Rs) shown in FIG. 3, the light transmittance drops. Then, the voltage value of the selection pulse applied during the selection period is again increased starting from Vb in FIG. 5. The relationship between the amount of light transmission and the applied voltage in this case is as shown by a dashed line (2) in FIG. 5. This means that the threshold voltage at which a transition from the first stable state to the second stable state occurs has changed. It is presumed that this change is caused because the state (in this case, the white display state) written to the pixel before the reset period cannot be completely restored to the initial state even after a reset is done in the reset period.

This slight change in the threshold voltage apparently changes the characteristics of the ferroelectric liquid crystal. That is, the slope of the change of the light transmittance of the ferroelectric liquid crystal, at the time the state changes from the first stable state to the second stable state in response to the applied voltage, was (V2–V1) in the initial state as shown by the solid line (1) in FIG. 5, but because the slope has changed as shown by the dashed line (2), the apparent slope is expressed as shown by a semi-dashed line (3). Accordingly, the apparent slope of the change of the light transmittance of the ferroelectric liquid crystal is now expressed by the value (V2–Vb). This degradation of the slope increases the absolute value of the signal voltage. As a result, flicker occurs on the display panel during the non-selection period following the selection period, causing problems such as an increased load on the drive circuit.

The present invention aims at preventing such a threshold voltage change occurring in a short period of time and resolving the problem of the image sticking phenomenon.

Figure 6:
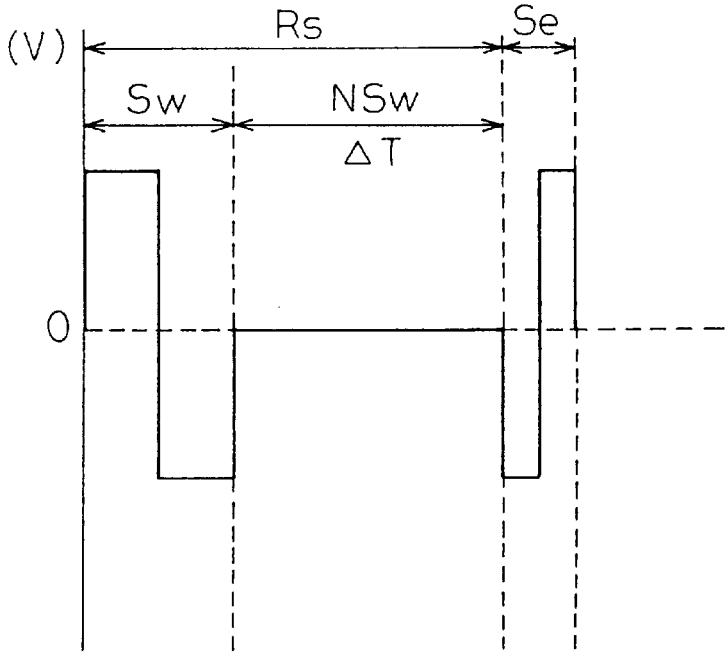
FIG. 6 is a diagram showing a driving scheme for the ferroelectric liquid crystal display element according to the present invention.

To prevent the threshold voltage change and resolve the problem of the image sticking phenomenon, the inventor investigated voltage waveforms applied during the reset period. As shown in FIG. 6, the reset period (Rs) was divided into two periods, a switching period (Sw) and a non-switching period (NSw); in this condition, a bipolar pulse, for example, was applied during the switching period, and a voltage of 0 V, i.e., no voltage, was applied during the non-switching period. Then, the light transmittance was measured while varying the voltage value of the selection pulse applied during the selection period (Se) for various lengths ΔT of NSw. The results showed that the amount of change of the threshold value varied with the length ΔT as shown by the graph of FIG. 7.

Figure 7:
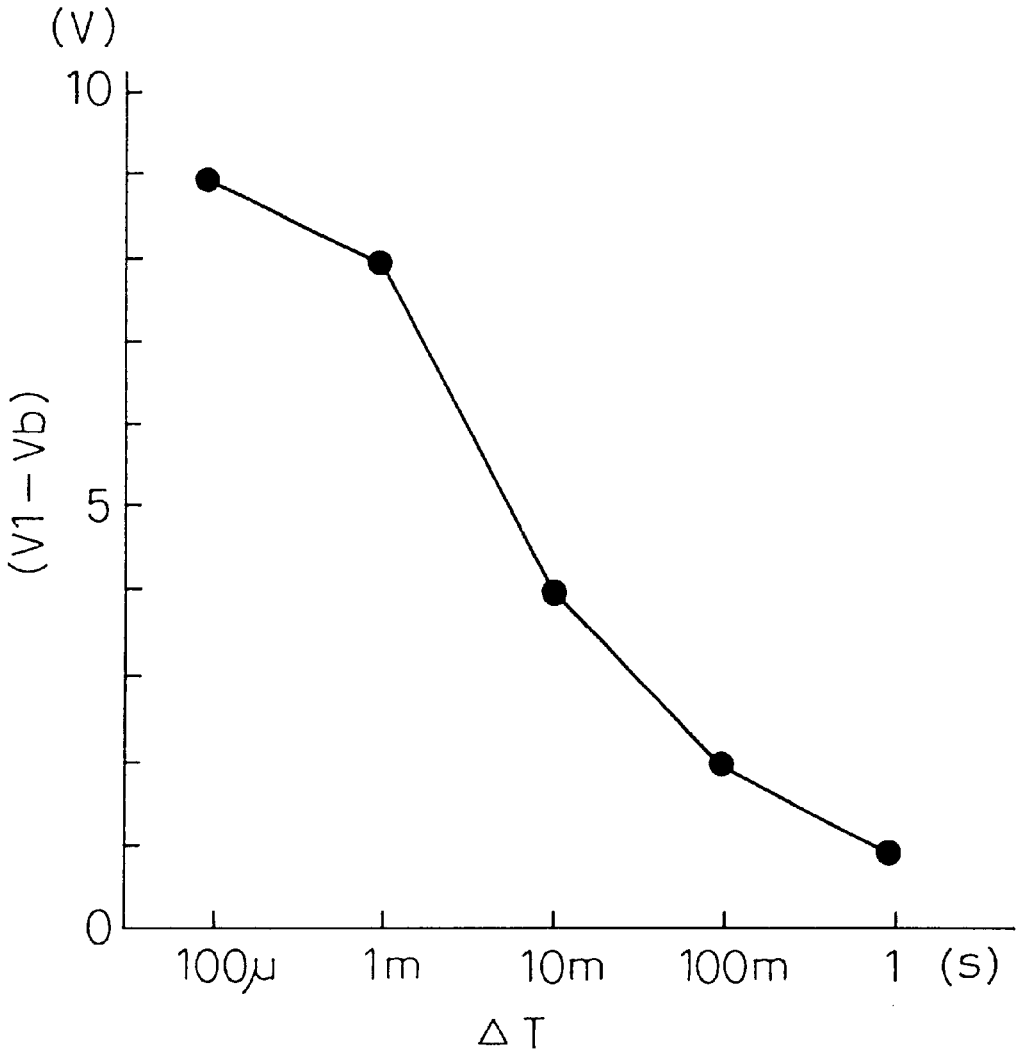
FIG. 7 is a diagram showing the change in the threshold voltage of the ferroelectric liquid crystal as a function of the length ΔT of a non-switching period in a driving method for the ferroelectric liquid crystal display element according to the present invention.

The graph of FIG. 7 shows V1–Vb as a function of ΔT, that is, the relationship between ΔT and the amount of change of the threshold voltage. As shown in FIG. 7, the amount of change of the threshold voltage decreases as ΔT is increased. The longer ΔT, the closer to 0 the amount of change of the threshold voltage becomes.

The values taken along the ordinate and abscissa of FIG. 7 vary depending on the ferroelectric liquid crystal material used.

The primary intent of the reset period is to prevent the orientation state and electrical properties of the liquid crystal molecules from varying from pixel to pixel before the selection period is begun. It can, however, be seen that if ΔT is not provided or the length is too short, the effect of the reset period is reduced.

Figure 8:
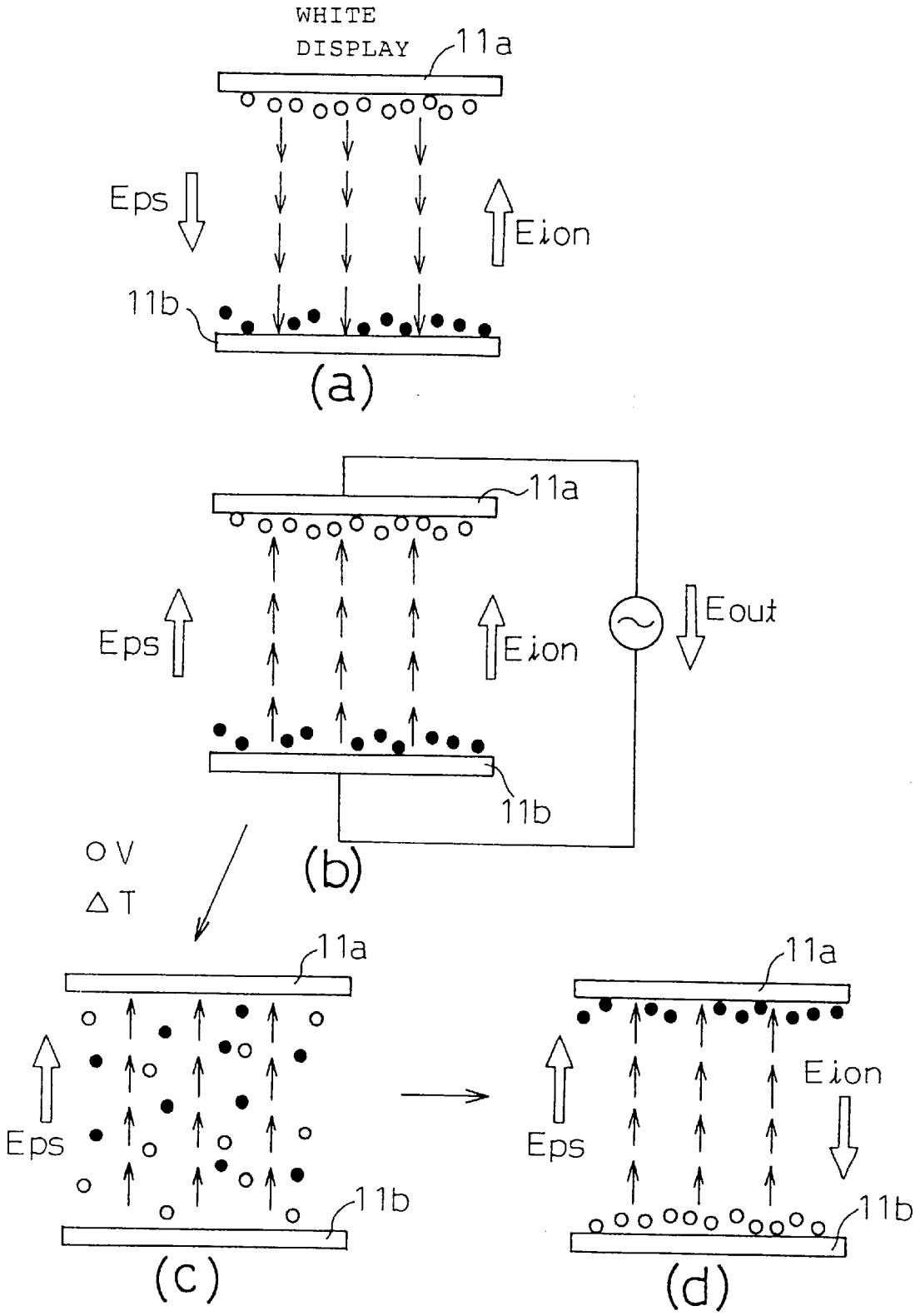
FIG. 8 is a diagram for explaining a mechanism that causes a change in the threshold voltage of the ferroelectric liquid crystal display element.
Figure 9:
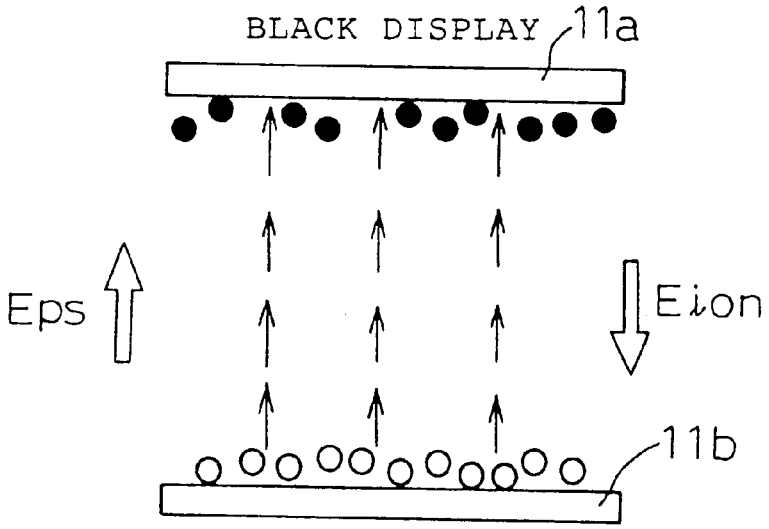
FIG. 9 is a diagram for explaining a mechanism that causes a change in the threshold voltage of the ferroelectric liquid crystal display element.
Figure 9:
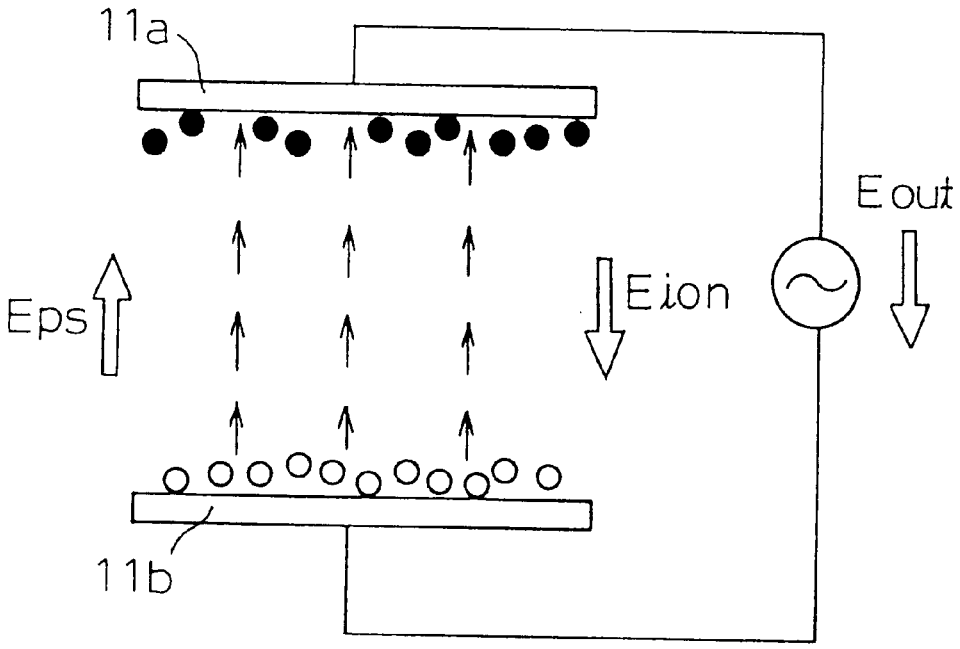

A detailed mechanism that explains why the provision of the non-switching period (NSw) ΔT contributes to reducing the threshold voltage change not clearly known yet. However, an attempt will be made to infer the mechanism by using the models shown in FIGS. 8 and 9. FIG. 8(*a*) shows the spontaneous polarization of the ferroelectric liquid crystal molecules and the state of ionic impurities in one pixel when the pixel was driven in the white display state before the reset period. On the other hand, FIG. 9(*a*) shows the state when the pixel was driven in the black display state before the reset period. Before the reset pulse is applied, the ferroelectric liquid crystal molecules in the pixel are aligned in one direction according to the display state before the application of the reset pulse, and the ionic impurities are clustered near the alignment films due to the action of the internal electric field (EPs) formed by the spontaneous polarization of the liquid crystal molecules.

Next, when the reset pulse (external electric field Eout) is applied, switching occurs in the ferroelectric liquid crystal molecules, and they switch to the state shown in FIG. 8(*b*) or 9(*b*). At this time, as shown in FIGS. 8(*b*) and 9(*b*), the direction of the spontaneous polarization of the liquid crystal molecules is the same, but the ionic impurities clustered near the alignment films remain there, being unable to move readily. At this time, the positions of the positive ions and negative ions of the ionic impurities in FIG. 8(*b*) are different from those in FIG. 9(*b*), that is, the direction of the ion electric field (Eion) is different. In this state, when the selection pulse is applied to the pixel in the selection period to put the pixel in the desired display state, if the direction of the ion electric field (Eion) is the same as the direction of the external electric field Eout, the effective electric field Er applied internally to the liquid crystal cell is expresses as Er=Eion+Eout. On the other hand, if the direction of the ion electric field (Eion) is opposite to the direction of the external electric field Eout, then Er=Eion−Eout. In this way, the direction of the ion electric field (Eion) due to the ionic impurities is different between the pixel that was driven in the black display state and the pixel that was driven in the white display state, and therefore, the value of the effective electric field Er differs even if the same external electric field (Eout) is applied; this presumably causes the change in the threshold voltage.

In view of this, as shown in FIG. 6, after applying a bipolar pulse as the external electric field (Eout) during the switching period (Sw) in the reset period (Rs), a voltage of 0 V is applied for the duration of ΔT in the non-switching period (NSw) to the pixels in the states shown in FIGS. 8(*b*) and 9(*b*). In this case, almost no change occurs in the state shown in FIG. 9(*b*). However, in the state shown in FIG. 8(*b*) for the pixel driven in the white display state, the positive ions and negative ions of the ionic impurities move away from the respective alignment films, as shown in the state of FIG. 8(*c*). When ΔT is made longer, the positive ions and negative ions move into the state shown in FIG. 8(*d*) in such a manner as to cancel the direction of the internal electric field (EPs). As a result, the direction of Eion in FIG. 8(*d*) is the same as that shown in the state of FIG. 9(*b*), and the threshold voltage change is thus reduced.

In the above example, since the ferroelectric liquid crystal is switched to the black display state (the first stable state) in the reset period, the effect of the non-switching period (NSw) is evident in the case of a pixel driven in the white display state before the reset period, such as the one shown in FIG. 8. However, in the case where the ferroelectric liquid crystal is switched, for example, to the white display state (the second stable state) in the reset period, it is presumed that the effect of the non-switching period (NSw) will be evident in the case of a pixel, such as the one shown in FIG. 9, that was driven in the black display state before the reset period.

The voltage applied for the time ΔT in the non-switching period has been described as being 0 V, that is, no voltage application. However, this voltage need only be set so that the ion electric field in the ferroelectric liquid crystal will be formed in such a direction that cancels the direction of the electric field formed by the spontaneous polarization of the liquid crystal molecules. For example, a similar effect can be obtained as long as the voltage is set to a value that does not cause the ferroelectric liquid crystal to switch to the other state, i.e., that does not exceed the threshold voltage of the ferroelectric liquid crystal. It will, however, be effective to set this voltage to 0 V, that is, no voltage application. It has also been found that when not using the display (that is, when leaving the display in a non-operating condition), if the pixels of the liquid crystal panel are all held in the same display state, and further, if this display state is made the same as the display state achieved by the application of the switching pulse in the reset period immediately before the selection period, then the threshold voltage change can be reduced when the liquid crystal is driven the next time, even if ΔT is set to a shorter time. More specifically, if the switching pulse as applied during the reset period is applied to all the pixels at the end of the liquid crystal display operation, the threshold voltage change can be suppressed.

Embodiments of the present invention will be described in detail below with reference to drawings.

Figure 10:
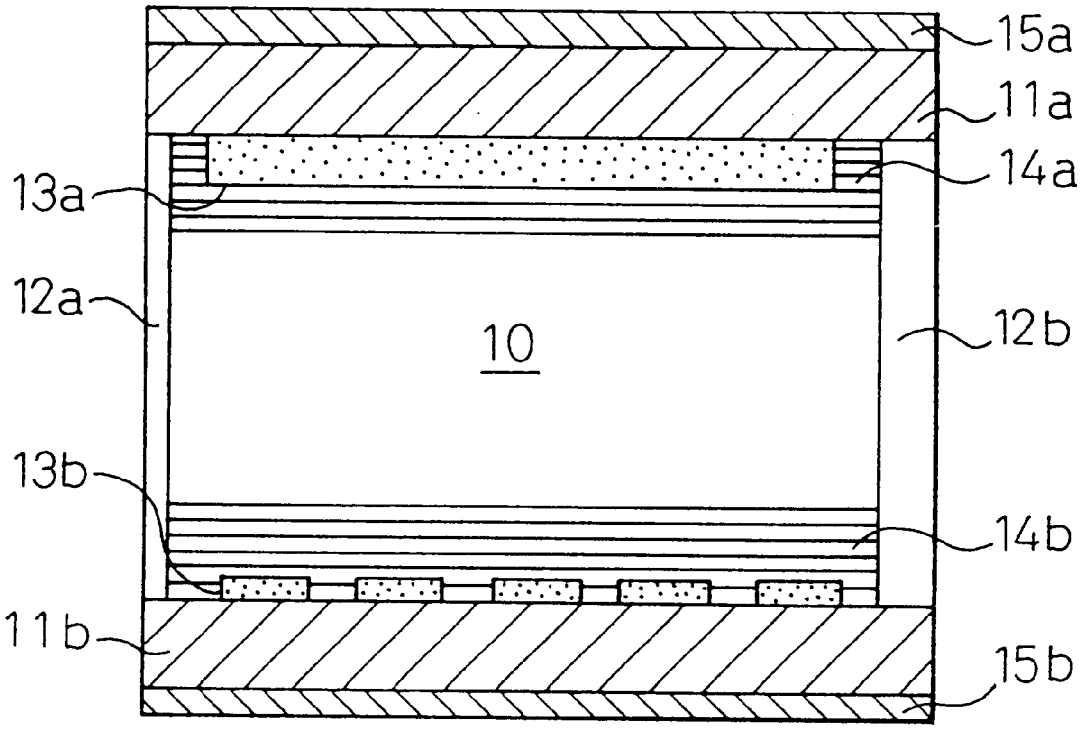
FIG. 10 is a diagram showing the structure of a ferroelectric liquid crystal panel used in the present invention.

FIG. 10 is a diagram showing the structure of a ferroelectric liquid crystal panel used for the construction of a liquid crystal display apparatus according to the present invention.

Figure 1:
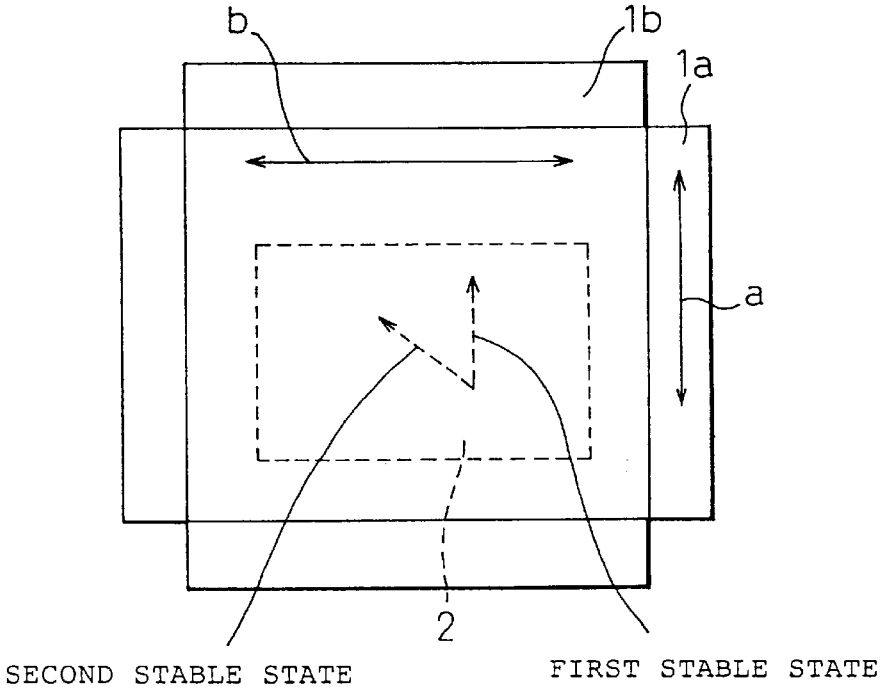
FIG. 1 is a diagram showing the structure of a ferroelectric liquid crystal display element used in the present invention.
Figure 2:
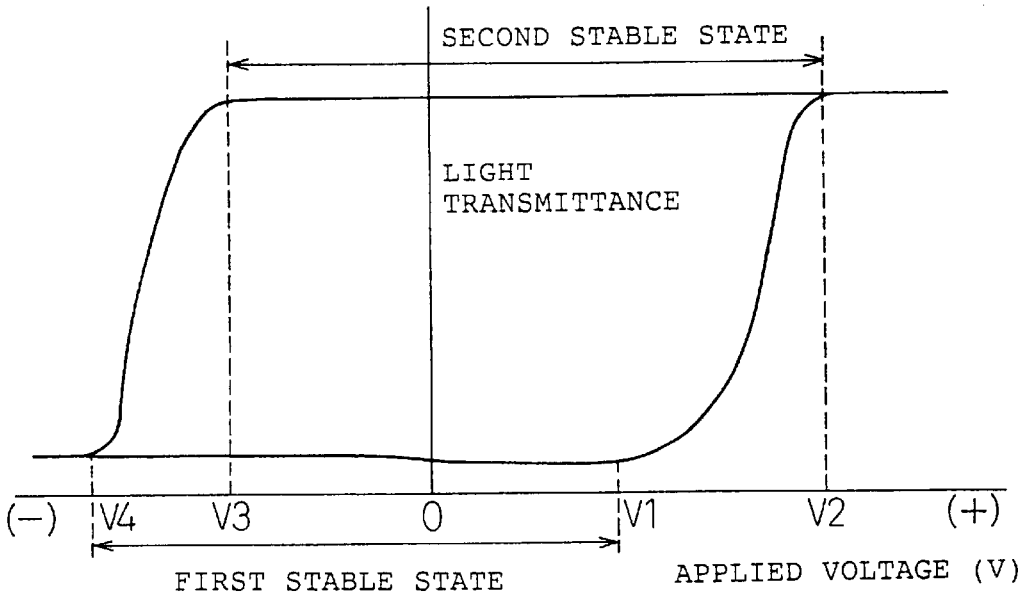
FIG. 2 is a diagram showing how the light transmittance of the ferroelectric liquid crystal display element used in the present invention varies with an applied voltage.
Figure 3:
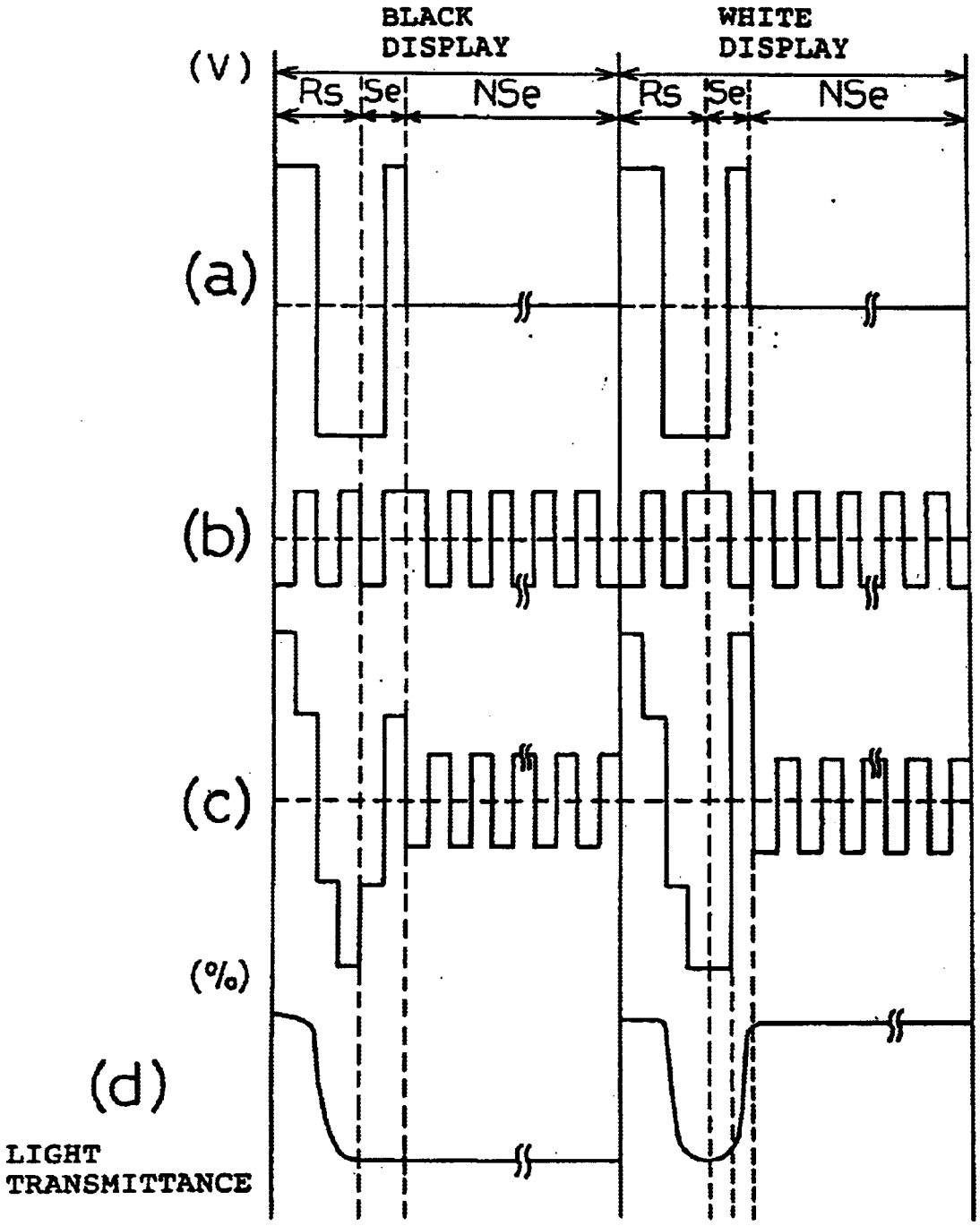
FIG. 3 is a diagram showing a conventional art driving method for a ferroelectric liquid crystal display element.

The ferroelectric liquid crystal used in the present invention has two stable states as shown in FIG. 2, and switches to the first or second stable state depending on the polarity of the applied voltage.

The liquid crystal panel used in the present invention, shown in FIG. 10, comprises a pair of glass substrates 11*a* and 11*b* holding therebetween a ferroelectric liquid crystal layer 10 having a thickness of about 1.7 μm. On the opposing surfaces of the glass substrates are formed scanning electrodes 13*a* and signal electrodes 13*b*, over which inorganic alignment films 14*a* and 14*b* are deposited. Further, a first polarizer 15*a* is disposed on the outside surface of one glass substrate so that the polarization axis of the polarizer is parallel to the long axis direction of liquid crystal molecules when the molecules are in the first stable state or in the second stable state, while on the outside surface of the other glass substrate, a second polarizer 15*b* is arranged with its polarization axis oriented at 90° to the polarization axis of the first polarizer 15*a*.

Embodiment 1

Figure 11:
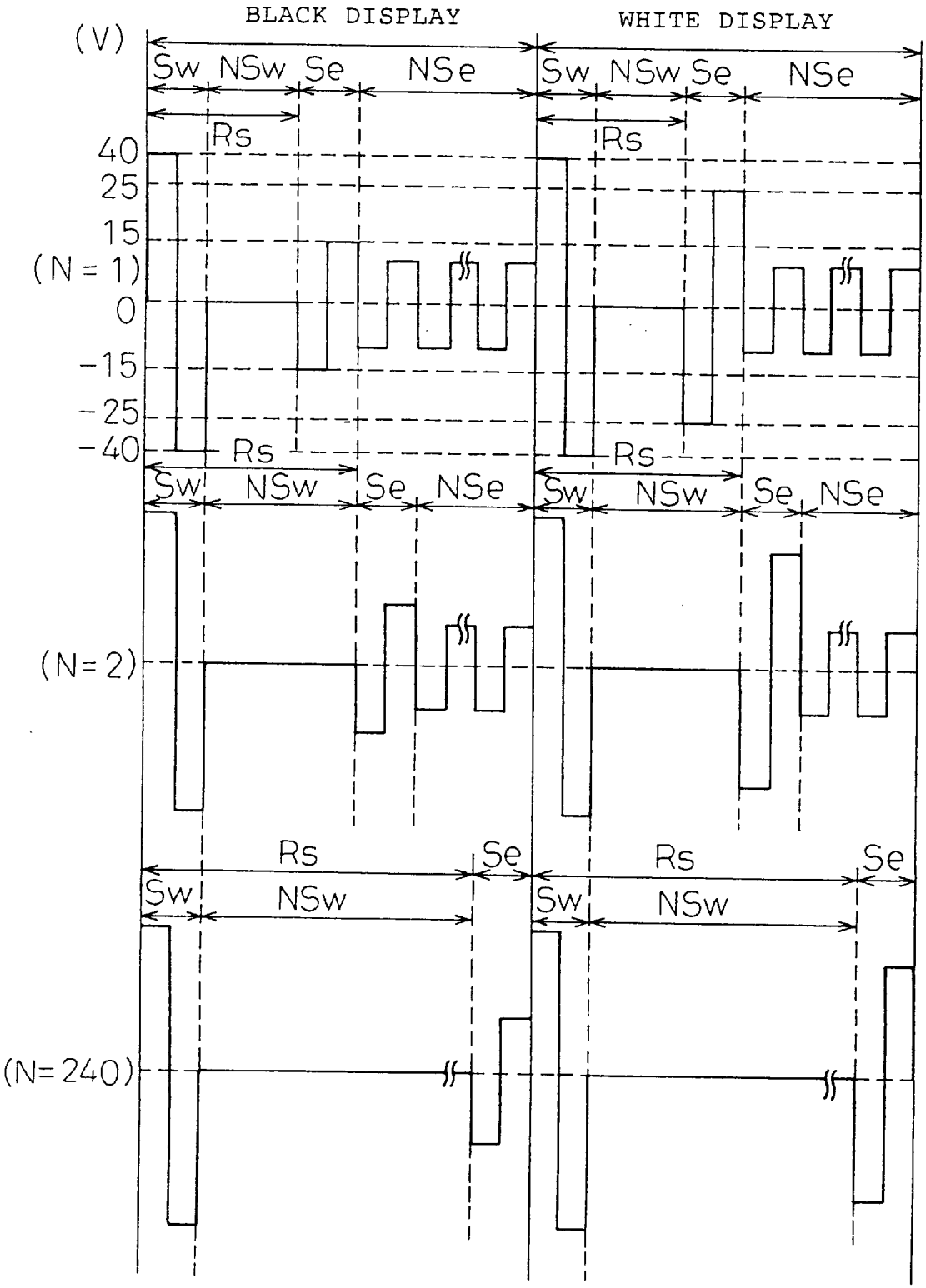
FIG. 11 is a diagram showing a driving scheme for the ferroelectric liquid crystal display element according to an embodiment of the present invention.

FIG. 11 is a diagram showing a combined driving voltage scheme according to a first embodiment of the present invention. This scheme corresponds to the combined voltage scheme shown in FIG. 3(*c*).

N=1 shows the combined voltage scheme applied to the pixels on the scanning electrode in the first row, N=2 the combined voltage scheme applied to the pixels on the scanning electrode in the second row, and N=240 the combined voltage scheme applied to the pixels on the scanning electrode in the 240th row. In the present invention, all the pixels were simultaneously placed in the black display state in the reset period (Rs) immediately preceding the period (selection period (Se)) during which necessary display data was written, and after that, writing was performed by applying the selection pulse to each scanning electrode in sequence. As shown in FIG. 6, the reset period (Rs) was divided into two periods, the switching period (Sw) and the non-switching period (NSw); a bipolar pulse of ±40 V with a pulse duration of 100 μs was applied during the switching period, and a voltage of 0 V was applied during the non-switching period. This period was followed by the selection period (Se) during which a selection pulse of ±15 V was applied in the case of a black display and ±25 V in the case of a white display.

In this case, since the reset pulse is applied to all the pixels simultaneously, as can be seen from FIG. 11, the timing for the application of the selection pulse becomes displaced from one scanning electrode to the next. As a result, the non-switching period (NSw) becomes gradually longer.

Though not shown here, provisions were made so that when the power switch of the apparatus was turned off, the bipolar pulse was applied to all the scanning electrodes simultaneously to place all the pixels in the same display state (black display state).

Figure 5:
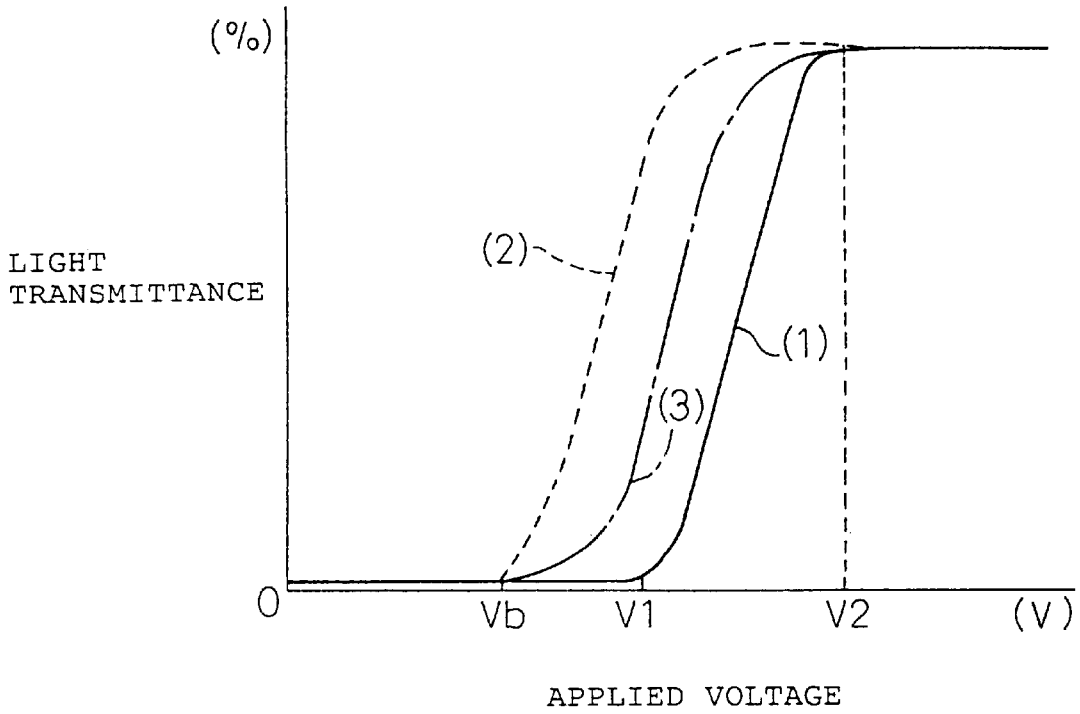
FIG. 5 is a diagram showing the relationship between the light transmittance and the applied voltage when the ferroelectric liquid crystal display element is driven by the conventional art driving method.
Figure 12:
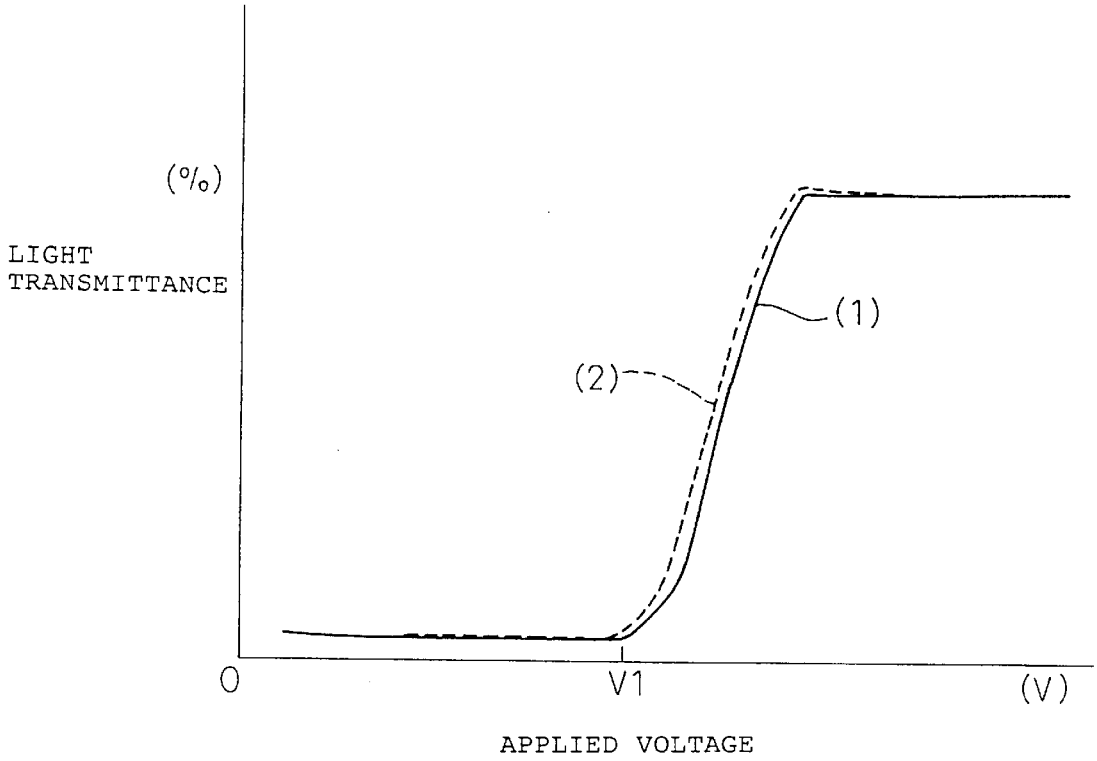
FIG. 12 is a diagram showing the relationship between the light transmittance and the applied voltage when the ferroelectric liquid crystal display element is driven according to the present invention.

For the liquid crystal display element described above, measurements were made on the threshold voltage change using the same method as used to obtain the graph of FIG. 5. The results are shown in FIG. 12. First, the selection pulse of the combined voltage was increased in increments of 0.5 V, starting from 0 V. As a result, when the voltage value of V1 shown in FIG. 2 was exceeded, the ferroelectric liquid crystal switched from the first stable state to the second stable state, causing the light transmittance to change and thus producing a white display. The relationship between the light transmittance and the applied voltage at this time is shown by a solid line (1) in FIG. 12. Next, the reset pulse having the non-switching period according to the present invention was applied to the same pixel, after which the selection pulse was applied; at this time, the voltage value was increased in increments of 0.5 V, starting from a value smaller than V1. The relationship between the light transmittance and the applied voltage in this case is shown by a dashed line (2) in FIG. 12. As shown by the dashed line (2), in FIG. 12, the result substantially coincided with the solid line (1). Accordingly, even after producing a white display, the slope of the change of the light transmittance of the ferroelectric liquid crystal, such as shown in FIG. 5, did not change, and hence, the threshold voltage remained substantially unaffected.

Embodiment 2

Figure 13:
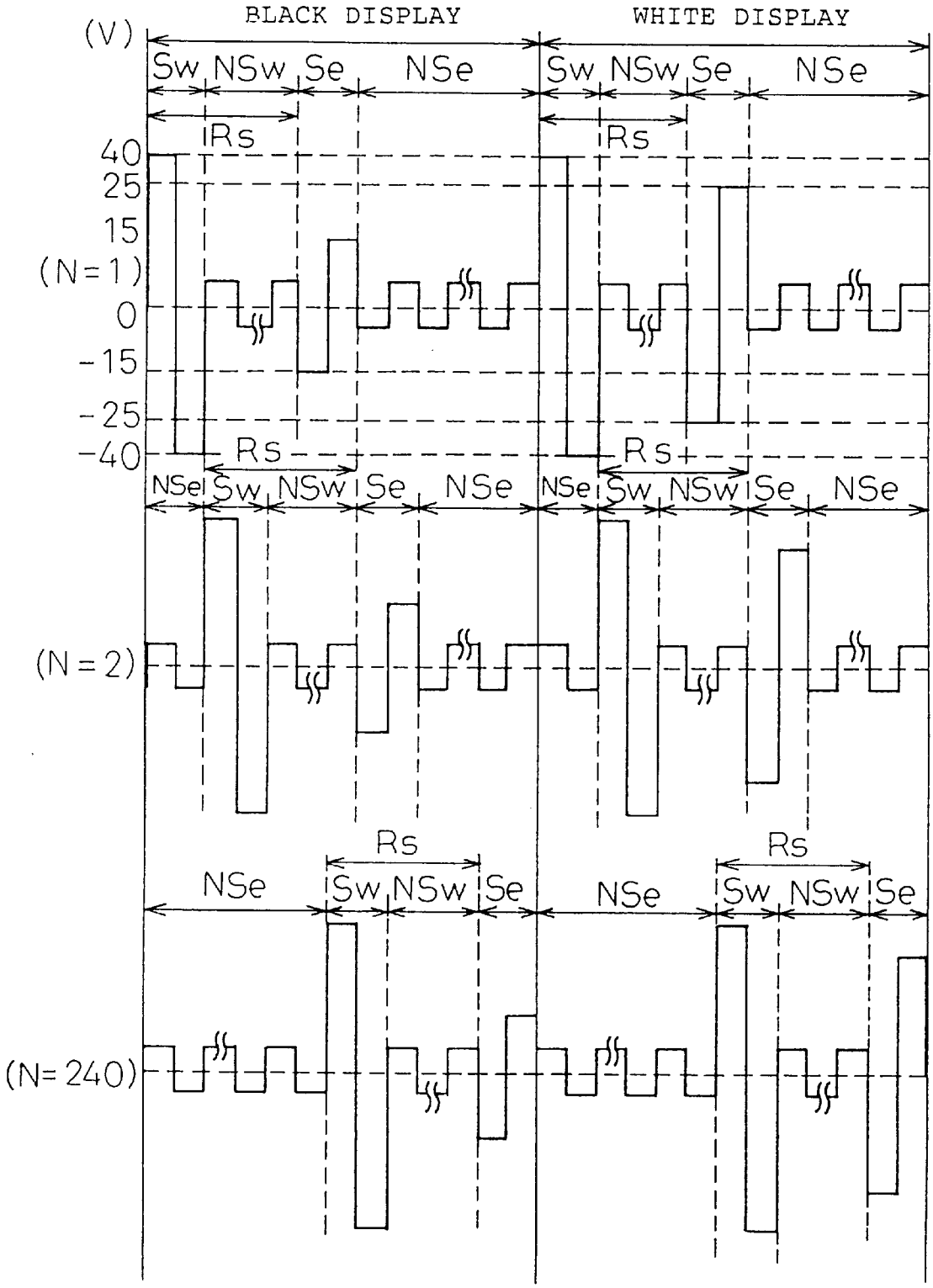
FIG. 13 is a diagram showing a driving scheme for the ferroelectric liquid crystal display element according to another embodiment of the present invention.

FIG. 13 is a diagram showing a combined drive voltage scheme according to a second embodiment of the present invention. In this embodiment, the reset period (Rs) was provided each time display data was written to a pixel. For each scanning line, the reset period was set so that the lengths of the switching period (Sw) and non-switching period (NSw) were respectively the same for all the pixels. The reset period (RS) was set to 8.2 ms in length for each pixel, and the switching period (Sw) and the non-switching period (NSw) about 8 ms in length were provided. The bipolar pulse applied during the switching period (Sw) and the voltage value applied during the selection period (Se) were the same as those used in the first embodiment. As a result, the amount of change of the threshold voltage was made equal for all the scanning lines, achieving a better display quality.

In the present embodiment, a black display was produced in the reset period, but as a matter of course, the same results were obtained when a white display was produced in the reset period. Furthermore, in the present embodiment, the pixels were driven using the scanning electrodes and signal electrodes, but the same results were obtained in the case of an active matrix display where a drive electrode is provided for each pixel.

What is claimed is:

1. A ferroelectric liquid crystal display element having pixels and comprising:

a ferroelectric liquid crystal sandwiched between a pair of substrates; and means for providing a driving waveform for the element, the waveform including a reset period followed by a selection period, the reset period having a switching period and a non-switching period, wherein, during the switching period, a reset voltage exceeding a threshold voltage required to switch said ferroelectric liquid crystal is applied irrespective of display data to be written to a pixel of the element, and during said non-switching period, ionic impurities are moved by an electric field produced by a spontaneous polarization of ferroelectric liquid crystal molecules, which is reversed by the reset voltage applied during the switching period, thereby an ion electric field caused by the ionic impurities in said ferroelectric liquid crystal is aligned stably in such a direction that cancels the direction of the electric field produced by spontaneous polarization of the ferroelectric liquid crystal molecules, and said non-switching period comprising a period during which the voltage applied to the ferroelectric crystal is 0V and having a length $\Delta T$ which is set so as to reduce a change in said threshold voltage to nearly zero.

2. A ferroelectric liquid crystal display element as claimed in claim 1, wherein a set of bipolar pulses are applied during said switching period.

3. A ferroelectric liquid crystal display element as claimed in claim 1, wherein said reset period is set at the same timing for all pixels.

4. A ferroelectric liquid crystal display element as claimed in claim 1, wherein said reset period is set each time display data is written to a pixel.

5. A ferroelectric liquid crystal display element as claimed in claim 4, wherein the length of said non-switching period is the same for all pixels.

6. A ferroelectric liquid crystal display element as claimed in claim 1, wherein all pixels are set to receive a switching pulse as applied during said reset period, before a display operation of the ferroelectric liquid crystal display element is switched off.

7. A method for driving a ferroelectric liquid crystal display element having pixels and comprising a ferroelectric liquid crystal sandwiched between a pair of substrates, the method comprising:

effecting a reset period followed by a selection period, the reset period having a switching period and a non-switching period, applying, during said switching period, a reset voltage exceeding a threshold voltage required to switch said ferroelectric liquid crystal irrespective of display data to be written to a pixel, and during said non-switching period, moving ionic impurities by an electric field produced by a spontaneous polarization of ferroelectric liquid crystal molecules, which is reversed by the reset voltage applied during the switching period, and thereby, aligning stably an ion electric field caused by the ionic impurities in said ferroelectric liquid crystal in such a direction that it cancels the direction of the electric field produced by spontaneous polarization of the ferroelectric liquid crystal molecules, and said non-switching period comprises a period during which the voltage applied to the ferroelectric liquid is 0V and having a length $\Delta T$ which is set so as to reduce a change in said threshold voltage to nearly zero.

8. A method for driving a ferroelectric liquid crystal display element claimed in claim 7, wherein said voltage applied during said switching period is a set of bipolar pulses.

9. A method of driving a ferroelectric liquid crystal display element as claimed in claim 7, wherein said reset period is set with the same timing for all pixels.

10. A method of driving a ferroelectric liquid crystal display element as claimed in claim 7, wherein said reset period is set each time display data is written to a pixel.

11. A method for driving a ferroelectric liquid display element, as claimed in claim 10, wherein the length of said non-switching period is the same for all pixels.

12. A method of driving a ferroelectric liquid crystal display element as claimed in claim 7, wherein a switching pulse, as applied during said reset period, is applied to all pixels before a display operation is switched off.

* * * * *